US005360567A

United States Patent [19]

Fry et al.

[11] Patent Number: 5,360,567

[45] Date of Patent: Nov. 1, 1994

[54] DETERGENT COMPOSITIONS

[75] Inventors: Alan J. Fry, South Wirral; Michael J. Garvey, Wirral; Douglas Wraige, Chester, all of England

[73] Assignee: Lever Brothers Company, Division of Conopco, Inc., New York, N.Y.

[21] Appl. No.: 59,526

[22] Filed: May 10, 1993

Related U.S. Application Data

[63] Continuation of Ser. No. 729,329, Jul. 12, 1991, abandoned.

[30] Foreign Application Priority Data

Jul. 13, 1990 [GB] United Kingdom ..... 9015503

[51] Int. Cl.[5] ..... C11D 17/00; C11D 3/08

[52] U.S. Cl. ..... 252/90; 252/174; 252/135; 252/174.17; 252/174.21; 252/174.25; 252/DIG. 16; 252/176

[58] Field of Search ..... 252/90, 174, 135, 174.17, 252/174.21, 174.25, DIG. 16, 176

[56] References Cited

U.S. PATENT DOCUMENTS

| | | | |
|---|---|---|---|
| 3,081,267 | 3/1963 | Laskey | 252/DIG. 16 |
| 3,231,505 | 1/1966 | Farrar et al. . | |
| 3,446,893 | 5/1969 | Hanford et al. | 252/90 |
| 3,953,350 | 4/1976 | Fujino et al. . | |
| 4,219,436 | 8/1980 | Gromer et al. | 252/174.21 |
| 4,370,250 | 1/1983 | Joshi | 252/135 |
| 4,370,250 | 1/1983 | Joshi . | |
| 4,587,031 | 5/1986 | Kruse et al. | 252/135 |
| 4,839,078 | 6/1989 | Kruse et al. | 252/174 |

FOREIGN PATENT DOCUMENTS

| | | |
|---|---|---|
| 2-182972 | 7/1990 | Japan . |
| 850366 | 10/1960 | United Kingdom . |
| 911204 | 11/1962 | United Kingdom . |
| 983243 | 2/1965 | United Kingdom . |
| 989683 | 4/1965 | United Kingdom . |
| 1080066 | 8/1967 | United Kingdom . |
| 1438647 | 6/1976 | United Kingdom . |

OTHER PUBLICATIONS

European Patent Report, Week 9009, p. 106, English Abstract of EP 0355,626 (Henkel) Feb. 29, 1990.

Derwent Abstract of Japanese Patent No. 62030197 (Lion Corp.) Feb. 9, 1987.

Derwent Abstract of Japanese Patent No. 62030198 (Lion Corp.) Feb. 9, 1987.

English Abstract of French Patent No. 2372890-A (Colgate Palmolive Co.) Aug. 1978.

Derwent Abstract of Japanese Patent No. 2182972 (Kao Corp.) Jul. 17, 1990.

English Abstract of German Patent No. 3326459-A (Etol-Werk GmbH) Jan. 31, 1985.

English Abstract of German Patent No. 3827-895-A (Henkel KGAA) Feb. 22, 1990.

Derwent Abstract of Japanese Patent No. 60135497 (Lion Corp.) Jul. 18, 1985.

Derwent Abstract of Japanese Patent No. 60135498 (Lion Corp.) Jul. 18, 1985.

Derwent Abstract of Japanese Patent No. 60015500 (Lion Corp.) Jan. 26, 1985.

*Primary Examiner*—Paul Lieberman
*Assistant Examiner*—Michael P. Tierney
*Attorney, Agent, or Firm*—James J. Farrell

[57] ABSTRACT

A tablet of compacted particulate detergent composition comprises a detergent-active compound, a detergency builder, and optionally other detergent ingredients. The tablet, or a discrete region thereof, consists essentially of a matrix of particles substantially all of which have a particle size within a range having upper and lower limits each lying within the range of from 200 to 2000 μm and differing from each other by not more than 700 μm.

14 Claims, No Drawings

DETERGENT COMPOSITIONS

This is a continuation of Ser. No. 07/729,329 filed Jul. 12, 1991, now abandoned.

TECHNICAL FIELD

The present invention relates to detergent compositions in the form of tablets of compacted detergent powder.

BACKGROUND AND PRIOR ART

Detergent compositions in tablet form are known in the art, as discussed below, and some products are now on the market. Tablets have several advantages over powdered products: they do not require measuring and are thus easier to handle and dispense into the washload, and they are more compact, hence facilitating more economical storage.

Detergent tablets are described, for example, in GB 911 204 (Unilever), U.S. Pat. No. 3,953,350 (Kao), JP 60 015 500A (Lion), JP 60 135 497A (Lion) and JP 60 135 498A (Lion); and are sold commercially in Spain.

Detergent tablets are generally made by compressing or compacting a detergent powder. It has proved difficult, however, to strike a balance between tablet strength and ability to disperse and dissolve in the wash liquor. Tablets formed using only a light compaction pressure tend to crumble and disintegrate on handling and packing; while more strongly compacted tablets may be sufficiently cohesive but will then fail to disintegrate or disperse to an adequate extent in the wash.

This problem has proved especially acute with tablets formed by compressing conventionally produced spray-dried powders containing detergent-active compounds and built with insoluble sodium aluminosilicate (zeolite). As the tablet is wetted, highly viscous gel phases are apparently formed which retard or prevent penetration of water into the interior of the tablet.

It would appear that the problem of disintegration in the wash liquor arises to a much lesser extent when sodium tripolyphosphate is present in the formulation, because the ready solubility and high heat of hydration of the phosphate cause it to behave as a tablet disintegrant. Preparation of satisfactory tablets from modern formulations where sodium tripolyphosphate has been replaced by an insoluble material, crystalline sodium aluminosilicate (zeolite), is proving considerably more difficult.

GB 983 243 and GB 989 683 (Colgate-Palmolive) disclose detergent tablets having improved dissolution properties, prepared by compacting spray-dried detergent powders that have been sprayed with water or with aqueous sodium silicate solution in order to reduce the proportion of fine particles (smaller than 100 mesh (US), equivalent to 149 μm) present. Compaction of powders having particle size ranges of 8–100 mesh and 6–60 mesh (US), equivalent respectively to 149–2380 μm and 250–3360 μm, is disclosed. The powders contain high levels of sodium tripolyphosphate.

It has now been found that greatly improved disintegration and dispersion properties may be obtained from a tablet consisting essentially of a matrix of compacted granules of relatively uniform size and shape, the particle size range being relatively narrow and the particle shape being relatively regular and uniform. The benefits are especially apparent in tablets prepared from zeolite-built detergent powders, and from high-bulk-density detergent powders. The tablets of the invention have the added bonus of an especially attractive appearance.

DEFINITION OF THE INVENTION

The present invention accordingly provides a tablet of compacted particulate detergent composition comprising a detergent-active compound, a detergency builder, and optionally other detergent ingredients, characterised in that the tablet, or a discrete region thereof, consists essentially of a matrix of particles substantially all of which have a particle size within a range having upper and lower limits each lying within the range of from 200 to 2000 μm and differing from each other by not more than 700 μm.

DETAILED DESCRIPTION OF THE INVENTION

The detergent tablet of the invention, or a discrete region of the tablet, is in the form of a matrix derived by compaction from a particulate composition consisting essentially of particles of relatively uniform size and shape, the particle size range being relatively narrow and the particle shape being relatively regular and uniform.

The tablet of the invention may be either homogeneous or heterogeneous. In the present specification, the term "homogeneous" is used to mean a tablet produced by compaction of a single particulate composition, but does not imply that all the particles of that composition will necessarily be of identical composition. The term "heterogeneous" is used to mean a tablet consisting of a plurality of discrete regions, for example, layers, inserts or coatings, each derived by compaction from a particulate composition.

In a heterogeneous tablet, any one or more of the discrete regions may consist essentially of a matrix as defined above. Where two or more such matrices are present in different regions, they may have the same or different particle size ranges: for example, a first region (for example, layer) may consist essentially of relatively small particles (for example, 250 to 500 μm) while another may consist essentially of relatively large particles (for example, 1000 to 1500 μm).

The tablet (if homogeneous) or region (in a heterogeneous tablet) may advantageously be constituted substantially wholly by the matrix defined above. The regularity and uniformity of the particles gives a particularly pleasing appearance; if desired, more visual interest may be achieved by colouring a minor proportion of the particles.

It is also within the scope of the invention, however, for a minor proportion of visually contrasting particles not within the size range of the matrix to be present: the most obvious example of this being the inclusion of a small proportion of much larger particles. In this embodiment of the invention, the visually contrasting particles must be larger in at least one dimension than the matrix particles. The effect of contrast may be enhanced if the non-matrix particles are of a contrasting shape, for example, noodles. Visual contrast may if desired be further emphasised by the use of a contrasting colour.

Particle size and distribution

The matrix which is an essential feature of the detergent tablet of the invention is derived by compaction from a particulate detergent composition of closely controlled particle size and distribution.

The starting composition should consist substantially wholly of particles within the size range of 200 to 2000 μm, preferably from 250 to 1500 μm, more preferably from 400 to 1000 μm and especially from 500 to 750 μm, and should be substantially free of both larger and smaller particles. Additionally, the particle size should be as uniform as possible. The upper and lower limits of the particle size range should not differ by more than 700 μm, preferably do not differ by more than 500 μm, and desirably do not differ by more than 300 μm.

Thus the particles making up the detergent tablet of the invention substantially all have particle sizes lying within a narrow range, itself lying within the broader range of 200 to 2000 μm. By "substantially all" is meant that not more than 5 wt % of particles should be larger than the upper limit, and not more than 5 wt % should be smaller than the lower limit.

This distribution is quite different from that of a conventional spray-dried detergent powder. Although the average particle size of such a powder is typically about 300–500 μm, the particle size distribution will be relatively wide: a "fines" (particles ≦180 μm) content of 10–30 wt % and a similar proportion of particles ≧1000 μm are typical.

Such a powder may nevertheless be a suitable starting material for a tablet according to the present invention, if a suitable particle size distribution is first obtained by sieving, and/or possibly by some kind of granulation process. Granulation processes that increase the uniformity and regularity of the shape of the particles are particularly suitable; and processes resulting in granules which are substantially spherical or spheroidal are especially preferred.

Granulation may, for example, be carried out using the process and apparatus described and claimed in GB 1 517 713 (Unilever), known as the Marumerizer (Trade Mark).

Granulation processes that produce a particulate composition of relatively high bulk density are especially preferred. While the starting particulate composition may in principle have any bulk density, the present invention is especially relevant to tablets made by compacting powders of relatively high bulk density, because of their greater tendency to exhibit disintegration and dispersion problems. Such tablets have the advantage that, as compared with a tablet derived from a low-bulk-density powder, a given dose of detergent composition can be presented as a smaller tablet.

Thus the starting particulate composition may suitably have a bulk density of at least 400 g/liter, preferably at least 500 g/liter, and advantageously at least 700 g/liter.

Granular detergent compositions of high bulk density prepared by granulation and densification in a high-speed mixer/granulator, as described and claimed in EP 340 013A (Unilever), EP 352 135A (Unilever) and EP 425 277A (Unilever), or by the continuous granulation/densification processes described and claimed in EP 367 339A (Unilever) and EP 390 251A (Unilever), are inherently suitable for use in the present invention.

Most preferred are granular detergent compositions prepared by granulation and densification in the high-speed mixer/granulator (Fukae mixer), as described in the above-mentioned EP 340 013A (Unilever) and EP 425 277A (Unilever). With some compositions, this process can produce granular compositions satisfying the criteria of particle size distribution, and uniformity and regularity of particle shape, given above, without sieving or other further treatment.

As previously indicated, it is not necessary for all the particles constituting the matrix to be of identical composition. The particulate starting composition may be a mixture of different components, for example, a spray-dried detergent base powder, surfactant particles, additional builder salts, bleach ingredients and enzyme granules, provided that all satisfy the criteria on particle size, and preferably also on particle shape, given above.

Disintegration

The detergent tablet of the invention should be capable of rapid disintegration in the wash liquor. For the purposes of the present invention, disintegration time has been investigated by means of the following test.

The tablet is weighed, placed in a cage of perforated metal gauze (9 cm×4.5 cm×2 cm) having 16 apertures (each about 2.5 mm square) per $cm^2$. The cage is then suspended in a beaker of demineralised water at 20° C. and rotated at 80 rpm. The time taken for the tablet to disintegrate and fall through the gauze (the disintegration time) is recorded; after 10 minutes, if the tablet has not wholly disintegrated, the residue is determined by weighing after drying.

It will be appreciated that this is a very stringent test, since water temperature and agitation are both much lower than in a real wash situation in a machine with a washload present. Disintegration times under real wash conditions are expected to be shorter.

The tablet of the invention should ideally have a disintegration time (as defined above) not exceeding 10 minutes, and preferably not exceeding 5 minutes. However, in view of the extreme stringency of the test methodology, a more realistic criterion correlating better with washing machine results (see below) appears to be that the residue after 10 minutes should preferably not exceed 75 wt %, and more preferably should not exceed 50 wt %.

Also important is the time taken for the tablet to disperse or dissolve, and thereby release its active ingredients into the wash liquor. Dissolution times have been investigated in a National W102 top-loading impeller-driven washing machine, using a 10-minute wash cycle and determining any undispersed residues remaining (by drying and weighing) after 5 minutes. During the 5-minute period, dissolution is monitored by conductivity measurement: the dissolution time is defined as the time taken for the conductivity to reach a plateau. It will be appreciated that conductivity measures only the dissolution of the water-soluble ingredients of the tablet, while any insoluble ingredients (notably zeolite) will simultaneously be dispersed.

Ideally a tablet suitable for use in this type of washing machine should be completely dispersed or dissolved in less than 5 minutes. It will be appreciated, however, that less stringent criteria need be applied when the tablet is intended for use in a washing machine, for example, a typical European drum-type machine, having a wash cycle involving a longer time period, a higher wash temperature or a greater degree of agitation.

Tabletting

As previously indicated, the tablets of the invention are prepared by compaction of a particulate starting material. Any suitable tabletting apparatus may be used.

For any given starting composition, the disintegration time (as defined above) will vary with the compaction pressure used to form the tablet. If the compaction pressure is too low, the tablet will tend to crumble and break up in the dry state, on handling and packaging; an increase in compaction pressure will improve tablet integrity, but eventually at the expense of disintegration time in the wash liquor.

Using an Instron (Trade Mark) Universal Testing Machine at constant speed, or a Research and Industrial screw hand press, to operate a steel punch and die, it has been found that effective tablets may be produced using compaction pressures ranging from 0.1 to 5 MPa, especially from 0.2 to 1 MPa.

The optimum compaction pressure will depend to some extent on the starting composition; for example, a formulation containing a high proportion of organic ingredients (for example, surfactants) and a low proportion of inorganic salts may require a compaction pressure lower than that required for a formulation containing a lower proportion of organic ingredients and a higher proportion of inorganic salts; and a dry-mixed formulation will generally require a higher pressure than will a spray-dried powder.

As a measure of the resistance of the tablets to fracture, the diametral fracture stress $\sigma_o$, also referred to in the literature as tensile strength, was determined as follows. The tablets were compressed diametrically at a rate of 1 cm/minute between the platens of an Instron Universal Testing Machine until fracture occurred, the applied load required to cause fracture was recorded, and the diametral fracture $\sigma_o$ calculated from the following equation:

$$\sigma_o = \frac{2P}{\pi Dt}$$

where $\sigma_o$ is the diametral fracture stress (Pa), P is the a applied load to cause fracture (N), D is the tablet diameter (M) and t is the tablet thickness (M).

Tablets of the invention preferably have a diametral fracture stress of at least 5 kPa, and more preferably at least 7 kPa.

Binder/Disintegrant

According to a highly preferred embodiment of the invention, the matrix particles before compaction are coated with a binder which is also capable of acting as a disintegrant by disrupting the structure of the tablet when the tablet is immersed in water.

Use of a binder helps to hold the tablet together, thus enabling it to be made using a lower compaction pressure and making it inherently more likely to disintegrate well in the wash liquor. If the binder is also a material that causes disruption when contacted with water, even better disintegration properties may be achieved.

Disruption may be by a physical mechanism, a chemical mechanism, or a combination of these. Tablet disintegrants are well known in the pharmaceutical art and are known to act by four principle mechanisms: swelling, porosity and capillary action (wicking), and deformation (all physical), and effervescence (chemical). Tablet disintegrants in the pharmaceutical industry are reviewed by W Lowenthal, Journal of Pharmaceutical Sciences Volume 61, No. 11 (November 1972).

Especially preferred are physical disintegrants that act by swelling. These include organic materials such as starches, for example, corn, maize, rice and potato starches and starch derivatives, such as Primojel (Trade Mark) carboxymethyl starch and Explotab (Trade Mark) sodium starch glycolate; celluloses and cellulose derivatives, for example, Courlose (Trade Mark) and Nymcel (Trade Mark) sodium carboxymethyl cellulose, Ac-di-Sol (Trade Mark) cross-linked modified cellulose, and Hanfloc (Trade Mark) microcrystalline cellulosic fibres; and various synthetic organic polymers, notably polyethylene glycol and crosslinked polyvinyl pyrrolidone, for example, Polyplasdone (Trade Mark) XL or Kollidon (Trade Mark) CL. Inorganic swelling disintegrants include bentonite clay.

Some disintegrants may additionally give a functional benefit in the wash, for example, supplementary building, antiredeposition or fabric softening.

A preferred binder/disintegrant is crosslinked polyvinyl pyrrolidone, for example, Polyplasdone (Trade Mark) XL or Kollidon (Trade Mark) CL.

An especially preferred binder/disintegrant is polyethylene glycol.

The binder/disintegrant is preferably used in an amount within the range of from 0.1 to 10 wt %, more preferably from 1 to 5 wt %.

It appears to be highly advantageous for the binder/disintegrant to coat or envelop the matrix particles, rather than simply to be mixed with them. The binder/disintegrant may suitably be applied to the particles by spraying on in solution or dispersion form; alternatively, the binder/disintegrant may be introduced by dry mixing, but preferably followed or accompanied by spray-on of a liquid and thorough mixing.

The need for a binder will depend to some extent on the type of formulation making up the particles. A formulation containing a high proportion of organic ingredients (for example, surfactants) and a low proportion of inorganic salts may need a lower level of binder than a "dry" formulation where the salt to surfactant ratio is high; and a spray-dried formulation may require less binder than a dry-mixed formulation.

It is also within the scope of the invention to use a binder that has no disintegrant properties, or a disintegrant that has no binder properties. An example of the latter type of material is an effervescent (chemical) disintegrant.

Effervescent disintegrants include weak acids or acid salts, for example, citric acid (preferred), malic acid or tartaric acid, in combination with alkali metal carbonate or bicarbonate; these may suitably be used in an amount of from 1 to 25 wt %, preferably from 5 to 15 wt %. Further examples of acid and carbonate sources and other effervescent systems may be found in Pharmaceutical Dosage Forms: Tablets, Volume 1, 1989, pages 287–291 (Marcel Dekker Inc, ISBN 0-8247-8044-2).

Tablet binders are well known in the art and include natural gums (for example, acacia, tragacanth) and sugars (for example, glucose, sucrose).

Tablet forms

The detergent tablet of the invention may be, and preferably is, formulated for use as a complete heavy-duty fabric washing composition. The consumer then does not need to use a mix of tablets having different compositions.

Although one tablet may contain sufficient of every component to provide the correct amount required for an average washload, it is convenient if each tablet contains a submultiple quantity of the composition required for average washing conditions, so that the consumer may vary the dosage according to the size and nature of the washload. For example, tablet sizes may be chosen such that two tablets are sufficient for an average washload; one or more further tablets may be added if the washload is particularly large or soiled; and one only tablet may be used if the load is small or only lightly soiled.

Alternatively, larger subdivisible tablets representing a single or multiple dose may be provided with scorings or indentations to indicate unit dose or submultiple unit dose size to the consumer and to provide a weak point to assist the consumer in breaking the tablet if appropriate.

The size of the tablet will suitably range from 10 to 160 g, preferably from 15 to 60 g, depending on the wash conditions under which it is intended to be used, and whether it represents a single dose, a multiple dose or a submultiple dose.

The tablet may be of any suitable shape, but for manufacturing and packaging convenience is preferably of uniform cross-section, for example, circular (preferred) or rectangular.

As previously indicated, the tablet of the invention may be homogeneous, or may consist of more than one discrete region: for example, two or more layers of different composition may be present, or a core region may be wholly surrounded by an outer region of different composition.

Detergent-active compounds

The total amount of detergent-active material in the tablet of the invention is suitably from 2 to 50 wt %, and is preferably from 5 to 40 wt %. Detergent-active material present may be anionic (soap or non-soap), cationic, zwitterionic, amphoteric, nonionic or any combination of these.

Anionic detergent-active compounds may be present in an amount of from 2 to 40 wt %, preferably from 4 to 30 wt %.

Synthetic anionic surfactants are well known to those skilled in the art. Examples include alkylbenzene sulphonates, particularly sodium linear alkylbenzene sulphonates having an alkyl chain length of $C_8$–$C_{15}$; primary and secondary alkyl sulphates, particularly sodium $C_{12}$–$C_{15}$ primary alcohol sulphates; olefin sulphonates; alkane sulphonates; dialkyl sulphosuccinates; and fatty acid ester sulphonates.

It may also be desirable to include one or more soaps of fatty acids. These are preferably sodium soaps derived from naturally occurring fatty acids, for example, the fatty acids from coconut oil, beef tallow, sunflower or hardened rapeseed oil.

Suitable nonionic detergent compounds which may be used include in particular the reaction products of compounds having a hydrophobic group and a reactive hydrogen atom, for example, aliphatic alcohols, acids, amides or alkyl phenols with alkylene oxides, especially ethylene oxide either alone or with propylene oxide.

Specific nonionic detergent compounds are alkyl ($C_{6-22}$) phenol-ethylene oxide condensates, the condensation products of linear or branched aliphatic $C_{8-20}$ primary or secondary alcohols wih ethylene oxide, and products made by condensation of ethylene oxide with the reaction products of propylene oxide and ethylenediamine. Other so-called nonionic detergent compounds include long-chain tertiary amine oxides, tertiary phosphine oxides, and dialkyl sulphoxides.

Especially preferred are the primary and secondary alcohol ethoxylates, especially the $C_{12-15}$ primary and secondary alcohols ethoxylated with an average of from 5 to 20 moles of ethylene oxide per mole of alcohol.

The nonionic detergent-active compounds are preferably concentrated is discrete domains. Since the nonionic detergent compounds are generally liquids, these domains are preferably formed from any of the well-known carriers in the detergent business impregnated by the nonionic detergent-active compound. These include zeolite; zeolite granulated with other materials, for example Wessalith CS (Trade Mark), Wessalith CD (Trade Mark), Vegabond GB (Trade Mark), sodium perborate monohydrate, Burkeite (spray-dried sodium carbonate and sodium sulphate as disclosed in EP 221 776 (Unilever)).

Nonionic detergent-active compounds may optionally be mixed with materials which make the granules slow wetting and/or prevent the nonionic leaching out into the main tablet matrix. Such materials may suitably be fatty acids, especially lauric acid as disclosed in EP 0 342 043A (Procter & Gamble).

Detergency builders

The detergent tablets of the invention contain one or more detergency builders, suitably in an amount of from 5 to 80 wt %, preferably from 20 to 80 wt %.

The invention is of especial relevance to tablets derived from detergent compositions containing alkali metal aluminosilicates as builders, since such tablets appear to have a particular tendency to exhibit disintegration and dispersion problems.

Alkali metal (preferably sodium) aluminosilicates may suitably be incorporated in amounts of from 5 to 60% by weight (anhydrous basis) of the composition, and may be either crystalline or amorphous or mixtures thereof, having the general formula:

$$0.8\text{–}1.5\ Na_2O.\ Al_2O_3.0.8\text{–}6\ SiO_2$$

These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature.

Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof. Also of interest is the novel zeolite P described and claimed in EP 384 070 (Unilever).

Other builders may also be included in the detergent tablet of the invention if necessary or desired: suitable organic or inorganic water-soluble or water-insoluble builders will readily suggest themselves to the skilled detergent formulator. Inorganic builders that may be present include alkali metal (generally sodium) carbonate; while organic builders include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates; and organic precipitant builders such as alkyl- and alkenylmalonates and succinates, and sulphonated fatty acid salts.

Especially preferred supplementary builders are polycarboxylate polymers, more especially polyacrylates and acrylic/maleic copolymers, suitably used in amounts of from 0.5 to 15 wt %, especially from 1 to 10 wt %; and monomeric polycarboxylates, more especially citric acid and its salts, suitably used in amounts of from 3 to 20 wt %, more preferably from 5 to 15 wt %.

Preferred tabletted compositions of the invention preferably do not contain more than 5 wt % of inorganic phosphate builders, and are desirably substantially free of phosphate builders. However, phosphate-built tabletted compositions are also within the scope of the invention.

Other ingredients

Tabletted detergent compositions according to the invention may also suitably contain a bleach system. This preferably comprises one or more peroxy bleach compounds, for example, inorganic persalts or organic peroxyacids, which may be employed in conjunction with activators to improve bleaching action at low wash temperatures.

Preferred inorganic persalts are sodium perborate monohydrate and tetrahydrate, and sodium percarbonate, advantageously employed together with an activator. Bleach activators, also referred to as bleach precursors, have been widely disclosed in the art. Preferred examples include peracetic acid precursors, for example, tetraacetylethylene diamine (TAED), now in widespread commercial use in conjunction with sodium perborate; and perbenzoic acid precursors. The novel quaternary ammonium and phosphonium bleach activators disclosed in U.S. Pat. No. 4,751,015 and U.S. Pat. No. 4,818,426 (Lever Brothers Company, Unilever Case C.6034) are also of great interest. The bleach system may also include a bleach stabiliser (heavy metal sequestrant) such as ethylenediamine tetramethylene phosphonate and diethylenetriamine pentamethylene phosphonate. The skilled detergent worker will have no difficulty in applying the normal principles of formulation to choose a suitable bleach system.

The detergent tablets of the invention may also contain one of the detergency enzymes well-known in the art for their ability to degrade and aid in the removal of various soils and stains. Suitable enzymes include the various proteases, cellulases, lipases, amylases, and mixtures thereof, which are designed to remove a variety of soils and stains from fabrics. Examples of suitable proteases are Maxatase (Trade Mark), as supplied by Gist-Brocades N.V., Delft, Holland, and Alcalase (Trade Mark), Esperase (Trade Mark) and Savinase (Trade-Mark), as supplied by Novo Industri A/S, Copenhagen, Denmark. Detergency enzymes are commonly employed in the form of granules or marumes, optionally with a protective coating, in amounts of from about 0.1% to about 3.0% by weight of the composition; and these granules or marumes present no problems with respect to compaction to form a tablet.

The detergent tablets of the invention may also contain a fluorescer (optical brightener), for example, Tinopal (Trade Mark) DMS or Tinopal CBS available from Ciba-Geigy AG, Basel, Switzerland. Tinopal DMS is disodium 4,4'bis-(2-morpholino-4-anilino-s-triazin-6-ylamino) stilbene disulphonate; and Tinopal CBS is disodium 2,2'-bis-(phenyl-styryl) disulphonate.

An antifoam material is advantageously included in the detergent tablet of the invention, especially if the tablet is primarily intended for use in front-loading drum-type automatic washing machines. Suitable antifoam materials are usually in granular form, such as those described in EP 266 863A (Unilever). Such antifoam granules typically comprise a mixture of silicone oil, petroleum jelly, hydrophobic silica and alkyl phosphate as antifoam active material, sorbed onto a porous absorbent water-soluble carbonate-based inorganic carrier material. Antifoam granules may be present in any amount up to 5% by weight of the composition.

It may also be desirable to include in the detergent tablet of the invention an amount of an alkali metal silicate, particularly sodium ortho-, meta- or preferably neutral or alkaline silicate. The presence of such alkali metal silicates at levels, for example, of 0.1 to 10 wt %, may be advantageous in providing protection against the corrosion of metal parts in washing machines, besides providing some measure of building and giving processing benefits.

Further ingredients which can optionally be employed in the detergent tablet of the invention include antiredeposition agents such as sodium carboxymethylcellulose, straight-chain polyvinyl pyrrolidone and the cellulose ethers such as methyl cellulose and ethyl hydroxyethyl cellulose; fabric-softening agents; heavy metal sequestrants such as EDTA; perfumes; pigments, colourants or coloured speckles; and inorganic salts such as sodium and magnesium sulphate- Sodium sulphate may if desired be present as a filler material in amounts up to 40% by weight of the composition; however as little as 10% or less by weight of the composition of sodium sulphate, or even none at all, may be present.

As well as the functional detergent ingredients listed above, there may be present various ingredients specifically to aid tabletting. Binders and disintegrants have already been discussed. Tablet lubricants include calcium, magnesium and zinc soaps (especially stearates), talc, glyceryl behapate, Myvatex (Trade Mark) TL ex Eastman Kodak, sodium benzoate, sodium acetate, polyethylene glycols, and colloidal silicas (for example, Alusil (Trade Mark) ex Crosfield Chemicals Ltd).

As indicated previously, some ingredients may give both functional wash benefits and tabletting benefits.

EXAMPLES

The following non-limiting Examples illustrate the invention. Parts and percentages are by weight unless otherwise stated. Examples identified by numbers are in accordance with the invention, while those identified by letters are comparative.

Examples 1 to 15

A high-bulk-density granular detergent composition was prepared to the following formulation:

| | % |
|---|---|
| Linear alkylbenzene sulphonate | 25.0 |
| Nonionic surfactant | 1.5 |
| Soap | 1.0 |
| Zeolite (anhydr.) | 35.0 |
| Water with zeolite | 10.0 |
| Na silicate | 4.0 |
| Acrylate/maleic anhydride copolymer (sodium salt) | 1.5 |
| Fluorescer | 0.18 |
| SCMC | 0.9 |
| Sodium carbonate | 15.5 |
| Enzyme (alcalase) | 0.6 |

-continued

| | % |
|---|---|
| Speckles, perfume, salts, water to 100 wt % | |

The composition was prepared as follows: all ingredients except the enzyme, speckles and perfume were slurried and spray-dried to give a base powder; the base powder was granulated and densified in the Fukae (Trade Mark) FS-100 high-speed mixer/granulator, as described and claimed in EP 340 013A (Unilever), to give a granular product of bulk density >720 g/liter; and enzymes, speckles and perfume were admixed.

The resulting product consisted of dense, substantially spherical granules, the particle size distribution being as follows:

| | wt % |
|---|---|
| <180 μm | 2.03 |
| 180–250 μm | 17.07 |
| 250–500 μm | 37.20 |
| 500–710 μm | 15.45 |
| 710–1000 μm | 10.98 |
| 1000–1700 μm | 14.63 |
| >1700 μm | 2.64 |
| | 100.00 |

It will be noted that although virtually the whole of the granules had sizes within the range of 180–1000 μm, the distribution over that range was quite wide. This product was therefore unsuitable for use as a matrix in the sense of the present invention without sieving.

Sieve fractions of the granular product were separated and divided into 15 g samples:

| | |
|---|---|
| Examples 1, 2, 3, 4, 5: | 500–710 μm |
| Examples 6, 7, 8: | 500–800 μm |
| Examples 9, 10, 11, 12, 13: | 250–500 μm |
| Examples 14, 15: | 1000–1600 μm |

Samples 2–8, 10, 11 and 15 were sprayed with a slurry of binder/disintegrant in acetone to give a coating level of 3–5 wt % as detailed below, the other samples were uncoated.

| | |
|---|---|
| Examples 6, 10, 11: | 3 wt % crosslinked polyvinyl pyrrolidone (Polyplasdone XL) |
| Examples 2, 3, 12, 13, 15: | 5 wt % crosslinked polyvinyl pyrrolidone (Polyplasdone XL) |
| Example 4: | 3 wt % sodium montmorillonite |
| Example 5: | 3 wt % bentonite clay |
| Example 7: | 3 wt % SCMC |
| Example 8: | 5 wt % acrylate/maleic anhydride copolymer |

Comparative Example A and B

As controls, similar tablets were prepared from the unsieved granular product.

Tablet Preparation

Detergent tablets were prepared by compaction of the detergent powder formulations of Examples 1 to 15 and Comparative Examples A and B at compaction pressures sufficient to produce a diametral fracture stress of at least 5 kPa, which was determined as described earlier. The actual diametral fracture stresses obtained are shown in the Table. The tablets were produced using an Instron Universal Testing Machine to operate a steel punch and 40 mm die. The tablets obtained were of circular cross-section having a diameter of 4.0 cm and a thickness of approximately 1 cm.

Determination of Tablet Properties

Disintegration and dissolution times, measured according to the tests previously described, were as shown in the following Table.

All the tablets according to the invention were made up of spherical granules of uniform size and were of substantially more attractive appearance than the control tablets of Examples A and B. The tablets of Examples 1 to 5 were judged to be especially pleasing to the eye.

Examples 1 to 15; Comparative Examples A and B

| Example | Sieve Fraction (μm) | Coating* (wt %) | Diametral Fracture Stress (kPa) | Compaction Pressure (MPa) | Disintegration Time (mins) | Tablet Residue (wt %) | Dissolution Time (mins) |
|---|---|---|---|---|---|---|---|
| A | unsieved | 0 | 4.3 | 0.4 | >10 | 75 | >5 |
| B | unsieved | 0 | 13.7 | 0.8 | >10 | 88.3 | >5 |
| 1 | 500–710 | 0 | 7.5 | 0.1 | — | 0 | 3.5 |
| 2 | 500–710 | 5 | 9.9 | 0.4 | 1.3 | 0 | 4.1 |
| 3 | 500–710 | 5 | 8.6 | 0.8 | >10 | 63 | 4.5 |
| 4 | 500–710 | 3 | 9.0 | 0.4 | — | 0 | 3.0 |
| 5 | 500–710 | 3 | 7.7 | 0.4 | — | 0 | 2.5 |
| 6 | 500–800 | 3 | 5.2 | 0.1 | — | 0 | 3.5 |
| 7 | 500–800 | 3 | 8.2 | 0.1 | — | 0 | 4.0 |
| 8 | 500–800 | 5 | 7.6 | 0.1 | — | 0 | 4.5 |
| 9 | 250–500 | 0 | 11.6 | 0.4 | 4.0 | 0 | 2.1 |
| 10 | 250–500 | 3 | 7.4 | 0.1 | — | 0 | 2.5 |
| 11 | 250–500 | 3 | 12.5 | 1.28 | >10 | 68.9 | <5.0 |
| 12 | 250–500 | 5 | 7.8 | 0.1 | — | 0 | 3.0 |
| 13 | 250–500 | 5 | 13.9 | 0.8 | >10 | 14 | 4.5 |
| 14 | 1000–1600 | 0 | 9.8 | 0.2 | >10 | 14 | <5 |
| 15 | 1000–1600 | 5 | 7.9 | 0.4 | 2.1 | 0 | 3.6 |

*See text for binder/disintegrant used.

Example 16

A granular detergent base composition was prepared to the following formulation:

| | Parts |
|---|---|
| Nonionic surfactant: | |

-continued

| | Parts |
|---|---|
| Tallow alcohol 8 EO | 3.75 |
| Coconut alcohol 6.5 EO | 5.0 |
| Soap (46 wt % unsaturated) | 13.1 |
| Zeolite 4A (anhydrous basis) | 43.8 |
| Sodium citrate | 6.25 |
| Sodium carbonate | 6.25 |
| Sodium succinate | 1.9 |
| Sodium silicate | 0.9 |
| Enzyme (savinase) granules | 1.0 |
| Perfume | 0.22 |

A base powder was first prepared by slurrying the tallow alcohol 8EO, soap (as fatty acid), zeolite, sodium citrate, sodium carbonate, sodium succinate (as succinic acid) and sodium silicate, spray-drying to form a powder, then spraying on the coconut alcohol 6.5EO. The base powder was then densified in a Fukae FS-100 high-speed mixer/granulator, as described in EP 425 277A (Unilever) to a bulk density of about 830 g/liter. The enzyme and perfume were then added.

The final product was sieved to 1000–1700 μm and compacted to form tablets having an attractive appearance by the method described in earlier Examples. Tablets containing 3 wt % of crosslinked polyvinyl pyrrolidone as binder/disintegrant had good end strength and exhibited satisfactory disintegration and dispersion behaviour.

We claim:

1. A tablet of compacted particulate detergent composition comprising from 2% to 50% by weight of the composition of a detergent-active compound selected from the group consisting of anionic, cationic, nonionic amphoterie, zwitterionic surface active agents and mixtures thereof, from 20% to 80% by weight of the composition of a detergency builder comprising alkali metal aluminosilicates, and optionally other detergent ingredients, characterized in that the tablet, or a discrete region thereof, consists essentially of a matrix of particles at least 90 wt % of which have a particle size within a range having upper and lower limits each lying within the range of from 200 to 2000 μm and differing from each other by not more than 700 μm wherein not more than 5 wt % of said particles should be larger than the upper limit and not more than 5 wt % of said particles should be smaller than the lower limit.

2. A detergent tablet as claimed in claim 1, wherein the upper and lower limits on the particle size of the particles constituting the matrix lie within the range of from 250 to 1500 μm.

3. A detergent tablet as claimed in claim 1, wherein the upper and lower limits of the particle size range of the matrix differ by not more than 500 μm.

4. A detergent tablet as claimed in claim 1, wherein the particles constituting the matrix are of substantially spherical or spheroidal.

5. A detergent tablet as claimed in claim 1, wherein the matrix constitutes substantially the whole of the tablet or discrete region thereof.

6. A detergent tablet as claimed in claim 1, wherein the matrix contains up to 5% of visually contrasting particles larger in at least one dimension than the particles constituting the matrix.

7. A detergent tablet as claimed in claim 1, which is a homogeneous tablet consisting essentially of a single matrix.

8. A detergent tablet as claimed in claim 1, wherein the matrix further comprises from 0.1 to 10 wt % (based on the tablet or discrete region thereof) of a binder capable of acting as a disintegrant capable, when the tablet is immersed in water, of disrupting the structure of the tablet.

9. A detergent tablet as claimed in claim 8, wherein the binder/disintegrant comprises polyethylene glycol.

10. A detergent tablet as claimed in claim 1, which gives a residue not exceeding 75 wt %.

11. A detergent tablet as claimed in claim 1, which has a disintegration time of ≦10 minutes.

12. A detergent tablet as claimed in claim 1, which has a dissolution time of ≦5 minutes.

13. A detergent tablet as claimed in claim 1, having a diametral fracture stress of at least 5.0 kPa.

14. A detergent tablet as claimed in claim 4 wherein the amount of detergent active is from 5% to 40% by weight of the composition.

* * * * *

UNITED STATES PATENT AND TRADEMARK OFFICE

CERTIFICATE OF CORRECTION

PATENT NO. : 5,360,567

DATED : NOVEMBER 1, 1994

INVENTOR(S) : ALAN J. FRY; MICHAEL J. GARVEY; DOUGLAS WRAIGE

It is certified that error appears in the above-indentified patent and that said Letters Patent is hereby corrected as shown below:

Column 13,

Claim 1, line 5, please change "amphoterie" to

—amphoteric—.

Signed and Sealed this

Thirty-first Day of January, 1995

*Attest:*

Bruce Lehman

BRUCE LEHMAN

*Attesting Officer*

*Commissioner of Patents and Trademarks*